US006505013B1

(12) United States Patent
Bedford et al.

(10) Patent No.: US 6,505,013 B1
(45) Date of Patent: Jan. 7, 2003

(54) SYSTEM AND METHOD FOR EXTENDING THE LIFE OF A CHARGE RECEPTOR IN A XEROGRAPHIC PRINTER

(75) Inventors: Keith L. Bedford, Ipswich (GB); Roger D. Masham, Herts (GB); Krzysztof J. Less, London (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/503,886

(22) Filed: Feb. 15, 2000

(51) Int. Cl.[7] ..... G03G 15/02
(52) U.S. Cl. ..... 399/50; 399/174; 399/176
(58) Field of Search ..... 399/50, 174, 176, 399/175

(56) References Cited

U.S. PATENT DOCUMENTS 4,862,213 A * 8/1989 Ichihara et al. ..... 399/58
4,961,088 A * 10/1990 Gilliland et al. ..... 399/25
5,159,388 A * 10/1992 Yoshiyama et al. ..... 399/50 X
5,394,221 A * 2/1995 Kishimoto et al. ..... 399/50 X
5,404,201 A * 4/1995 Umeda et al. ..... 399/8
5,412,455 A * 5/1995 Ono et al. ..... 399/176
5,475,472 A * 12/1995 Saito et al. ..... 399/176 X
5,613,173 A * 3/1997 Kunzmann et al. ..... 399/89
5,754,926 A * 5/1998 Sakuraba et al. ..... 399/174 X
5,768,653 A * 6/1998 Fare ..... 399/50

* cited by examiner

*Primary Examiner*—Fred L. Braun
(74) *Attorney, Agent, or Firm*—R. Hutter

(57) ABSTRACT

An apparatus and method are described for extending the life of a photoreceptor in xerographic printing. At a predetermined point in the life span of a photoreceptor, a correction circuit is interposed between the power supply and the charging device of the printer. Correction circuits of different designs can be selected to compensate for the photoreceptor properties at different stages of its useful life. The different correction circuits can be automatically activated over time, or can be retrofitted into a replaceable module when the replaceable module is remanufactured.

24 Claims, 4 Drawing Sheets

SYSTEM AND METHOD FOR EXTENDING THE LIFE OF A CHARGE RECEPTOR IN A XEROGRAPHIC PRINTER

FIELD OF THE INVENTION

The present invention relates to xerographic printing apparatus, and in particular relates to a system and method for extending the useful life of a charge receptor, such as a photoreceptor used in such apparatus.

BACKGROUND OF THE INVENTION

Electrostatographic printing methods, such as xerography, involve creation of an electrostatic latent image on a charge receptor, such as a photoreceptor. As is well known, in such apparatus, the photoreceptor is imagewise discharged in a manner conforming to an image desired to be copied or printed, and then this latent image is developed with toner. The developed toner image is in turn transferred to a print sheet, which is then fused to fix the transferred toner image thereon.

The properties of the charge receptor, such as a photoreceptor, are clearly very important to the overall functioning of a printing apparatus, and to the ultimate quality of images created therewith. The electrical stresses placed on a photoreceptor, with the printing of thousands of images therewith contributes to the degradation of the photoreceptor. As the photoreceptor degrades the quality of images that can be created therewith degrades as well. Thus, in practical embodiments of xerographic printers and copiers, it is inevitable that the photoreceptor will have to be periodically replaced. Replacement of the photoreceptor represents a large expense. It is therefore desirable to provide a method and system by which the photoreceptor, even a pre-existing photoreceptor, can be extended significantly.

DESCRIPTION OF THE PRIOR ART

In the prior art, U.S. Pat. No. 5,613,173 discloses a novel type of charging apparatus for use in charging the photoreceptor in a xerographic printer. In combination with the bias roll which initially charges the photoreceptor is a special "clipping" circuit comprising a diode and resistor. The clipping circuit has the function of clipping an oscillating voltage applied to the bias roll, and in turn to the photoreceptor, as the bias roll charges the photoreceptor. The long-term effect of this clipping is that lesser electrical stresses are experienced by the photoreceptor with extended use, and in turn the degradation of the photoreceptor is slowed down.

SUMMARY OF THE INVENTION

According to one aspect of the present invention, there is provided a method of operating an electrostatographic printing apparatus, the apparatus including a charge-retentive member defining an imaging surface and a charging device for placing a charge on the imaging surface, comprising the steps of determining an age of the charge-retentive member, and providing a correction circuit of a predetermined design associated with the charging device, as a result of said determining step.

According to another aspect of the present invention, there is provided various apparatus useful in electrostatographic printing in which a charging device places a charge on an imaging surface. The apparatus, which may itself be an electrostatographic printing apparatus, or a portion thereof, includes a correction circuit of a predetermined design associated with the charging device. The correction circuit can include various arrangements of diodes, zener diodes, resistors, and capacitors.

DETAILED DESCRIPTION OF THE INVENTION

Figure 1:
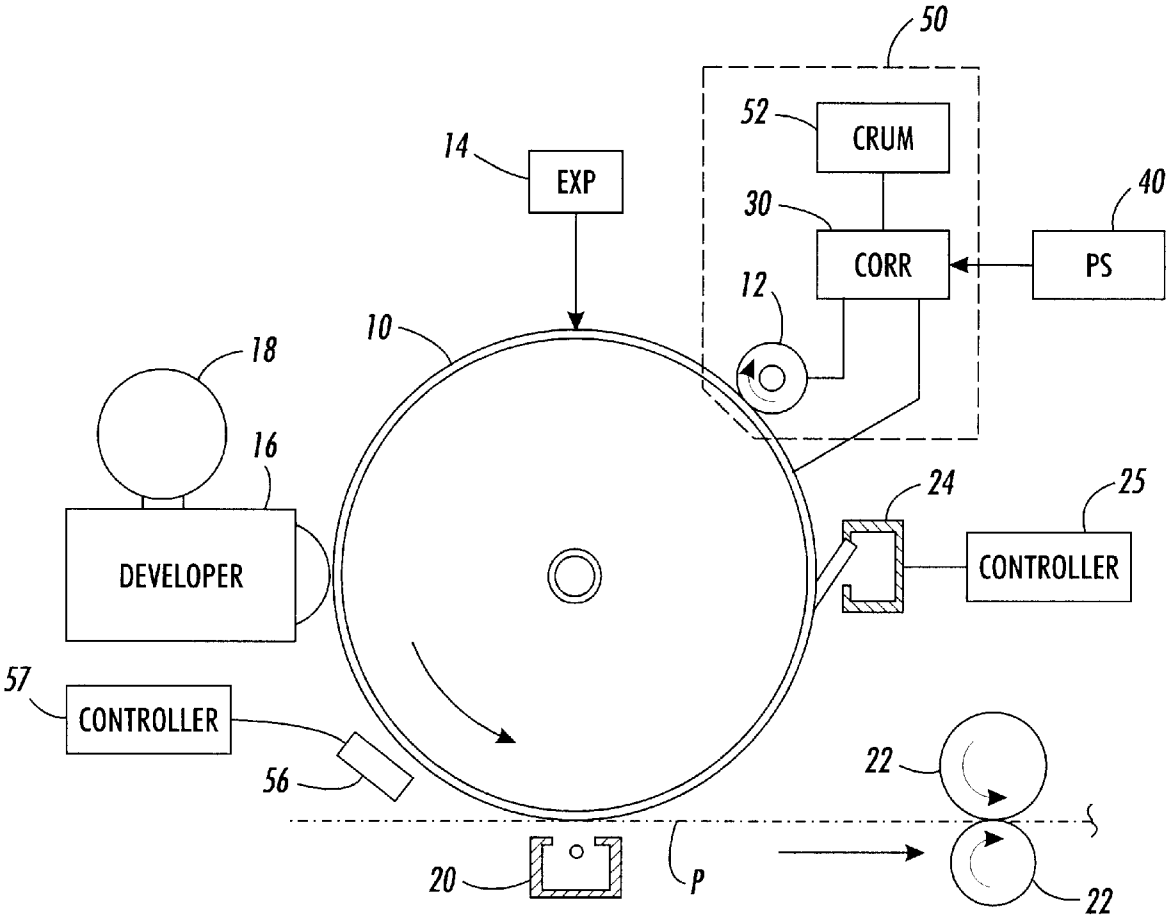
FIG. 1 is a simplified elevational view of the essential elements of a xerographic printer incorporating the present invention.

FIG. 1 is a simplified elevational view of the essential elements of a xerographic printing apparatus. As is well known in the art of xerography, a printing apparatus includes a rotatable photoreceptor 10, here in the form of a rotating drum, around the circumference of which are the various stations with which a series of images desired to be printed are created. Initially, a surface of the photoreceptor 10 is charged by charging device here indicated as 12. In various embodiments of printing apparatus, this charging device 12 can be in the form of a corotron, or other ion-generating device, but in this particular embodiment is in the form of a "bias charge roll" or BCR. The BCR 12 contacts or rolls against a surface of photoreceptor 10 along the length thereof, and places a uniform charge of predetermined magnitude on the surface of photoreceptor 10. After the surface of photoreceptor 10 has been uniformly charged, the surface is imagewise discharged by an exposure device here generally illustrated as 14. As is well known, such exposure devices typically include a scanning laser which is modulated in accordance with digital data, but other exposure devices include an LED array, ion source, or a lens arrangement for exposure of the photoreceptor 10 by a hard copy original image, such as in an analog copier.

Following exposure of the photoreceptor 10, the imagewise areas on photoreceptor 10 which are charged in a particular manner (such as charged to a certain polarity, or discharged, depending on the design of the apparatus) are developed by development unit 16. Typically, development unit 16 includes therein a supply of toner 18, which may be admixed with carrier, as is well known in the art. Following development of the image on photoreceptor 10, the developed image is transferred onto a print sheet, moving in the process direction indicated as capital P, at a transfer station here indicated as 20. The transfer station typically places a predetermined charge on the photoreceptor as the photoreceptor area is contacted by a print sheet, so that toner which has been placed on the photoreceptor is transferred to the print sheet.

The print sheet is then passed through a fuser indicated as 22, of any common design known in the art, which causes the toner image to be permanently fused onto the sheet. Finally, any toner that remains on the surface of photoreceptor 10 following the transfer step is scraped or otherwise removed from photoreceptor 10 by cleaning device 24.

With particular reference to the present invention, there is provided, associated with a charging device such as BCR 12, what is here called a "correction" circuit indicated as 30, which is operatively interposed between the BCR 12 and a power supply 40 (of course, the power supply 40 can serve other sub-systems within the apparatus as well). The intended behavior of the correction circuit 30 is generally to reduce the peak voltage of an AC component of a bias placed on the BCR 12 by power supply 40. As described generally in U.S. Pat. No. 5,613,173, the advantage of this "clipping" of the peak voltage of the AC component is that it causes the photoreceptor 10 to experience less electrical stresses, such as of rapid charging and discharging, which has been shown to contribute to the degradation of the electrical properties of the photoreceptor 10. In brief, by reducing these electrical stresses, the useful life of a photoreceptor 10 can be extended.

FIGS. 2–7 are a series of schematic diagrams showing various possible embodiments of a correction circuit 30 used in combination with the BCR 12 and photoreceptor 10. In general, with reference to the various FIGS. 2–7, the combination of the BCR 12 and photoreceptor 10 is effectively a capacitive load on the power supply 40. The value of this capacitive load varies from about 510 pf for a relatively old photoreceptor, to about 380 pf for a new photoreceptor 10. A thick photoreceptor, having an effective charge-retentive thickness of about 35 microns, has a value of about 250 pf. The relatively wide range of electrical properties of a combination of a particular photoreceptor 10 and BCR 12 is very high and for this reason any one of the various circuits 30 such as shown in FIGS. 2–7 may be found most useful for a particular apparatus, and for a particular stage in the life of a particular photoreceptor 10. For this reason, it is difficult to generalize about optimal values for the various circuit elements in the embodiments of FIGS. 2–7. In general, however, selection of parameters for the various elements in the various embodiments requires striking a balance between reducing the peak voltage of an AC component on the BCR 12, without noticeably degrading the ability to uniformly charge the photoreceptor 10.

Figure 2:
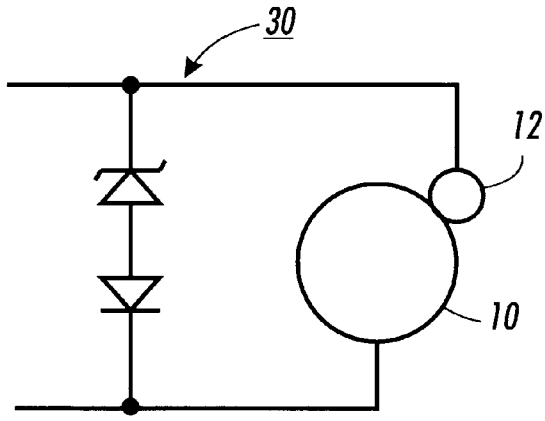
FIGS. 2–7 is a set of schematic diagrams showing possible correction circuits which may be used with the system and method of the present invention.
Figure 3:
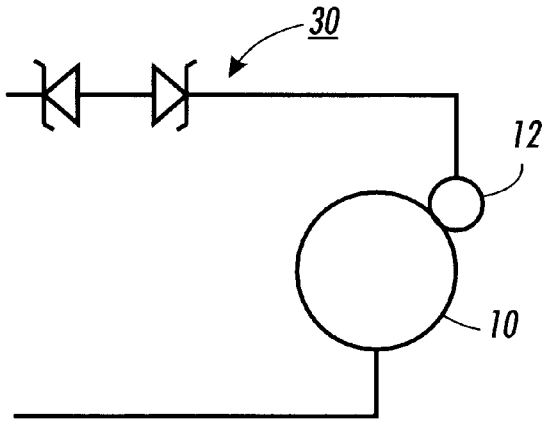
Figure 4:
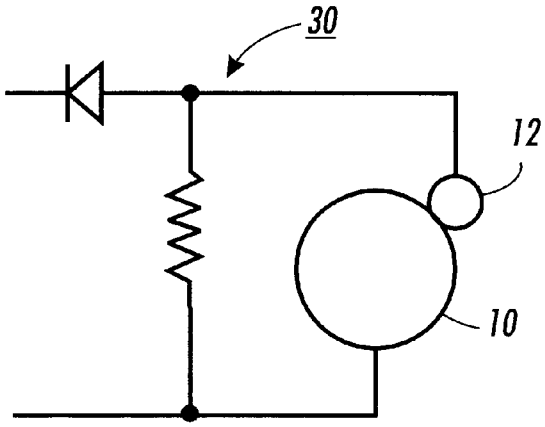
Figure 5:
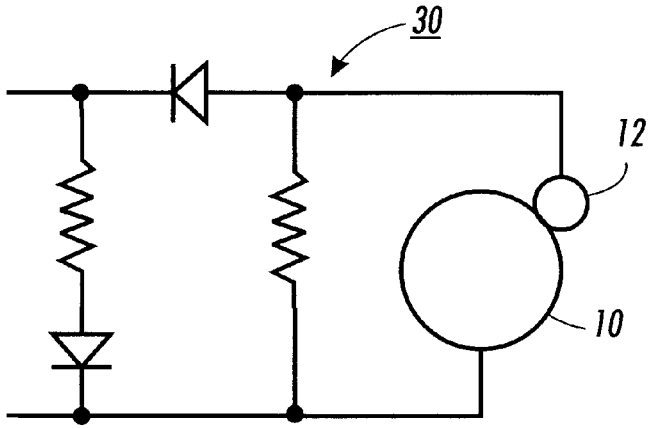
Figure 6:
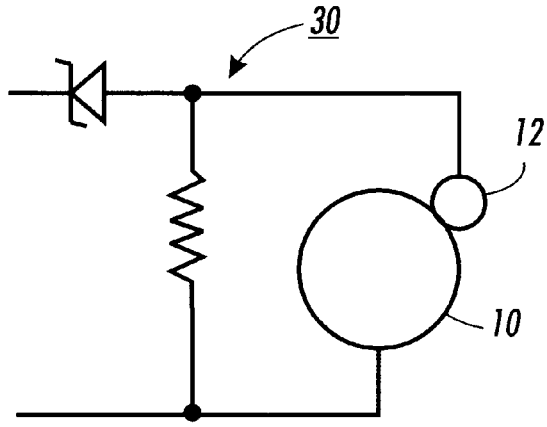
Figure 7:
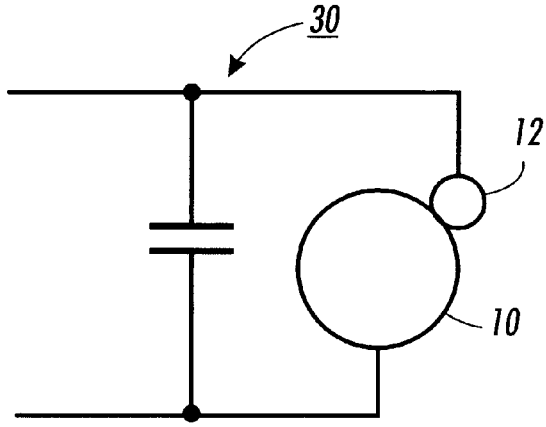

To briefly summarize the configurations of elements in the various embodiments: FIG. 2 shows a zener diode and regular diode oppositely oriented in parallel with the BCR/photoreceptor; FIG. 3 shows two zener diodes in opposite orientation in series with the BCR/photoreceptor: FIG. 4 shows a diode in series and a resistor in parallel with the BCR/photoreceptor; FIG. 5 shows a first parallel branch having a resistor and diode, a series branch having a diode, and a resistor in parallel to the BCR/photoreceptor; FIG. 6 shows a zener diode 30 in series and a resistor in parallel to the BCR/photoreceptor; FIG. 7 shows a capacitor in parallel with the BCR/photoreceptor. The correction circuit illustrated in U.S. Pat. No. 5,613,173 could also be useful as a correction circuit 30. To the best knowledge of the inventors as of the filing of the present application, the general circuit configurations shown in FIGS. 2 and 7 are the best for extending the life of a photoreceptor.

Regardless of the particular configuration of the correction circuit 30, another important aspect of the present invention is rooted in the fact that the electrical properties of the capacitive load between BCR 12 (or other charge-generating device) and photoreceptor 10 may change over the life of the apparatus: whatever is the most performance enhancing design and parameter set of a correction circuit 30 when the photoreceptor 10 is new, a suitable design of a correction circuit 30 will change over the life of photoreceptor 10. It is thus an aspect of the present invention to provide a system whereby a most-suitable correction circuit 30 (or, in some cases, the fact of having no correction circuit 30) is provided corresponding to the particular age of the particular photoreceptor 10. There are several different ways in which this principle can be addressed.

One system involves including the BCR 12, or other charging device, in a module which is periodically removed from a machine and reinstalled in the same machine or some other machine, such as customer replaceable unit (CRU) 50 as shown in FIG. 1. Depending on a particular design of a printing apparatus, the CRU 50 can include, in addition to the BCR 12, the photoreceptor 10 itself, a supply of developer or other consumable material, and/or one or more elements in the developer unit 16. What is important is that, by periodic replacement or reconditioning of CRU 50, a correction circuit 30 can be installed, replaced or otherwise altered, preferably to correspond to an optimal configuration that matches a determined or measured age of the photoreceptor 10. As used herein, the "age" of the photoreceptor 10 or BCR 12 can reflect a chronological age, relate to the number of images that have been printed therewith ("uses"), or relate to a performance characteristic which is known to vary with time or continued use of the photoreceptor 10.

In one embodiment of the present invention, the CRU 50 can include therein a customer replaceable unit monitor, or CRUM, indicated as 52. The general principle of the CRUM 52 as a chip which records the behavior and history of a module is known from, for example, U.S. Pat. No. 4,961,088. In the apparatus disclosed in that patent and in similar designs, an electronic chip such as an EEPROM essentially functions as an odometer recording the cumulative use of the particular replaceable module with which the chip is associated, although other CRUM designs may keep a record of other performance characteristics associated with the CRU 50.

According to one embodiment in the present invention, a CRU 50 which is removed from a particular printing apparatus and sent back to the manufacturer for remanufacturing is first checked for a cumulative print count stored in CRUM 52. If the remanufacturer observes that the cumulative print count in CRUM 52, representing the number of prints that were made with replaceable unit 50, and particularly if CRU 50 includes the photoreceptor 10 itself, exceeds a particular amount, than a particularly suitable correction circuit 30 is installed or activated to correspond with the cumulative life of the CRU 50. For example, if it has been found that when a new photoreceptor 10 of a particular design is operated up to 50,000 pages, and having no correction circuit 30 is most optimal, then no correction circuit 30 will be activated or installed. If, however, after 50,000 prints are made, the remanufacturer can install or activate a particular correction circuit 30. Depending on a particular design, the correction circuit 30 can be installed in the CRU 50 at manufacture, or may pre-exist on the originally made CRU 50 and be activated such as by entering a particular code into an interface on the CRU 50 (not shown). Alternately, there could be provided a system within CRU 50 whereby when the CRUM 52 or other software entity in the machine records a particular threshold number of prints that have been made with the replaceable unit, a suitable correction circuit 30 is automatically activated. This automatic activation of a correction circuit 30, indeed, can be performed whether or not the correction circuit 30 is part of a replaceable module.

It is also possible to have more than two different types of correction circuit 30 available for interposition between the BCR 12 and the power supply 40, with a "new" specifically-designed correction circuit 30 being interposed between BCR 12 and power supply 40 periodically, such as at every 10,000 prints, made with a particular apparatus. Even more to the point, it is possible to have an essentially continuously-variable parameter, such as a resistance or capacitance, available within correction circuit 30, which can be made to vary as a function of the accumulated use of a particular photoreceptor 10. Such arrangement may be particularly feasible if the correction circuit 30 is in the form of a circuit which can be digitally simulated, such as by a microprocessor.

Figure 8:
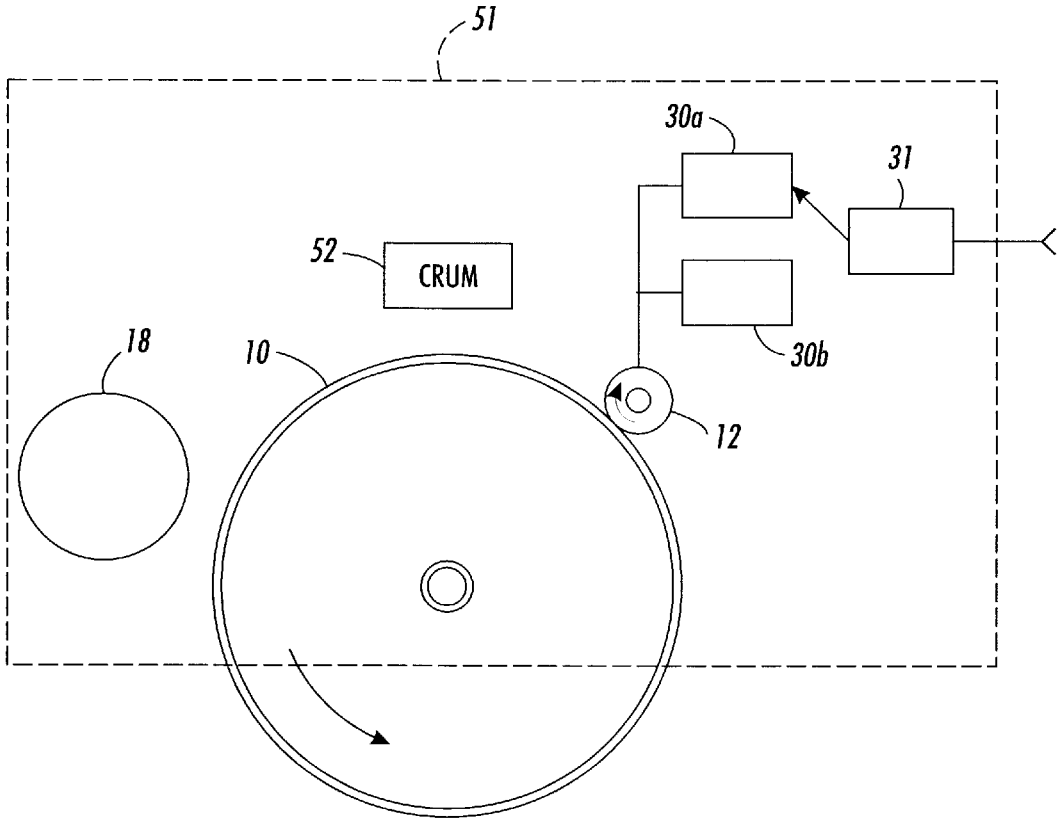
FIG. 8 is a simplified elevational view of a module, removable or installable in a larger printing apparatus, showing certain aspects of the present invention.

FIG. 8 is a diagram showing some essential elements of a CRU 50, illustrating numerous possible design options for a printing apparatus or CRU which can take advantage of the principle of the present invention. As shown in FIG. 8, the CRU can include photoreceptor 10, BCR 12, and/or a quantity of marking material 18 in a canister. In this embodiment, there are provided multiple correction circuits 30*a*, 30*b*, the specific design of each circuit being preferred depending on an age of the photoreceptor 10. There is also shown a selector circuit 31, which operates to associate a selected correction circuit 30*a* or 30*b* with the BCR 12 and photoreceptor 10. In this way, a suitable correction circuit can be provided as needed, depending on the measured or inferred age of the photoreceptor 10, without unusual operator intervention. The selector 31 is configured to select one or the other correction circuit in response to either a reading of photoreceptor age from CRUM 52, or by some other control system within the printing apparatus which indicates that a particular correction circuit would be most useful.

In addition to monitoring cumulative use of the photoreceptor 10 to determine a preferred configuration of a correction circuit 30, more direct measurements of the performance characteristics of photoreceptor 10 may be exploited; such a measurement can be considered an indirect determination of the "age" of the photoreceptor. For instance, returning to FIG. 1, there is typically provided, in many designs of xerographic printer, one or more sensors such as 56 which can measure, for example, the exact reflectivity of a test patch electrostatically placed on the photoreceptor 10 and subsequently developed; or, electrostatic voltage at some predetermined location along the photoreceptor 10 can be measured directly. The output of such a sensor 56 can be interpreted by control system 57 to determine whether the behavior of the photoreceptor 10 at a particular stage in its life would mandate the use or change of a correction circuit 30 of a particular configuration. Similarly, the behavior of cleaning apparatus 24 could be monitored for behavior consistent with poor transfer efficiency of transferring toner to a print sheet at transfer station 20: poor transfer efficiency is a direct indication of photoreceptor degradation. Thus, a monitor (not shown) associated with the cleaning station 24 could be fed into a control system 25 as a check for providing or activating a particular correction circuit 30.

Another technique for determining whether a particular correction circuit 30 of a particular design is mandated is to monitor the internal feedback systems, such as governing the biases of, for instance, the BCR 12 or development unit 16, or the power of the exposure device 14. These biases are typically controlled by feedback control systems (not shown) to optimize print quality. If the various control systems controlling the respective biases require the bias or power associated with one of these devices to be outside of a particular range, this situation could be seen as indicative of degradation (or, in a broad sense, an "age") of photoreceptor 10, and could then mandate activation or installation of a particular correction circuit 30.

In overview, a particular correction circuit 30 can be used either to extend the useful life of a photoreceptor 10 by limiting electrical stresses placed thereon as the photoreceptor is used, or can be used to adapt the bias on BCR 12 to compensate for past aging of the photoreceptor 10. By placing a correction circuit 30 in a replaceable module such as 50, the life-extending properties of a correction circuit 30 can be retrofitted into replaceable units such as 50 which have been sent back to the manufacturer for remanufacturing, as such the installation or activation of a correction circuit 30 can be made invisible to the bulk of a particular printing apparatus as a whole.

What is claimed is:

1. An apparatus useful in electrostatographic printing, wherein a charging device places a charge an imaging surface, comprising a monitor device for recording an age of the imaging surface a correction circuit associated with the charging device; and a selection circuit for activating the correction circuit.

2. The apparatus of claim 1, further comprising a member defining an imaging surface.

3. An apparatus useful in electrostatographic printing, wherein a charging device places a charge on an imaging surface, comprising a first correction circuit associated with the charging device;

a second correction circuit associated with the charging device; and a selection circuit for selectably activating one of the first correction circuit and the second correction circuit.

4. An apparatus useful in electrostatographic printing, wherein a charging device places a charge on an imaging surface, comprising a correction circuit associated with the charging device, the correction circuit comprising a diode in series with the charging device, the correction circuit comprising two oppositely-oriented diodes in series with the charging device.

5. The apparatus of claim 4, at least one of the two oppositely-oriented diodes being a zener diode.

6. A method of operating an electrostatographic printing apparatus, the apparatus including a charge-retentive member defining an imaging surface and a charging device for placing a charge on the imaging surface, comprising the steps of:

determining an age of the charge-retentive member; and providing a correction circuit of a predetermined design associated with the charging device, as a result of said determining step.

7. The method of claim 6, the determining step including measuring a performance characteristic of the charge-retentive member.

8. The method of claim 6, the determining step including determining a number of uses the charge-retentive member has experienced.

9. The method of claim 6, the providing step including installing the correction circuit in the printing apparatus.

10. The method of claim 6, the correction circuit comprising a diode in parallel with the charging device.

11. The method of claim 6, the correction circuit comprising two oppositely-oriented diodes in parallel with the charging device.

12. The method of claim 11, at least one of the two oppositely-oriented diodes being a zener diode.

13. The method of claim 6, the correction circuit comprising a diode in series with the charging device.

14. A method of operating an electrostatographic printing apparatus, the apparatus including a charge-retentive member defining an imaging surface and a charging device for placing a charge on the imaging surface, comprising the steps of:

determining an age of the charge-retentive member; and installing a correction circuit of a predetermined design associated with the charging device, as a result of said determining step, the installing step including the step of providing the correction circuit in a module which is installable in the printing apparatus, the module including the charge-retentive member.

15. A method of operating an electrostatographic printing apparatus, the apparatus including a charge-retentive member defining an imaging surface and a charging device for placing a charge on the imaging surface, comprising the steps of:

determining an age of the charge-retentive member; and installing a correction circuit of a predetermined design associated with the charging device, as a result of said determining step, the installing step including the step of providing the correction circuit in a module which is installable in the printing apparatus, the module including the charging device.

16. A method of operating an electrostato graphic printing apparatus, the apparatus including a charge-retentive member defining an imaging surface and a charging device for placing a charge on the imaging surface, comprising the steps of:

determining an age of the charge-retentive member; and installing a correction circuit of a predetermined design associated with the charging device, as a result of said determining step, the installing step including the step of providing the correction circuit in a module which is installable in the printing apparatus, the module including a quantity of marking material.

17. A method of operating an electrostatographic printing apparatus, the apparatus including a charge-retentive member defining an imaging surface and a charging device for placing a charge on the imaging surface, comprising the steps of:

providing the charge-retentive member in a module separable from the apparatus, the module further including a device for retaining data;

determining an age of the charge-retentive member, the determining step including reading, from the device in the module, a datum relating to the age of the module; and installing a correction circuit of a predetermined design associated with the charging device, as a result of said determining step.

18. A method of operating an electrostatographic printing apparatus, the apparatus including a charge-retentive member defining an imaging surface and a charging device for placing a charge on the imaging surface, comprising the steps of:

determining an age of the charge-retentive member; and providing a correction circuit of a predetermined design associated with the charging device, as a result of said determining step, the providing step including the steps of providing the correction circuit in an inactive form, and activating the correction circuit as a result of said determination.

19. The method of claim 18, the providing step including the steps of providing the correction circuit in a module removable from the printing apparatus, and activating the correction circuit as a result of said determination.

20. The method of claim 19, further comprising the step of reading, from a device in the module, a datum relating to the age of the module.

21. A method of operating an electrostatographic printing apparatus, the apparatus including a charge-retentive member defining an imaging surface and a charging device for placing a charge on the imaging surface, comprising the steps of:

determining an age of the charge-retentive member; and providing a correction circuit of a predetermined design associated with the charging device, as a result of said determining step, the correction circuit comprising two oppositely-oriented diodes in series with the charging device.

22. The method of claim 21, at least one of the two oppositely-oriented diodes being a zener diode.

23. A method of operating an electrostatographic printing apparatus the apparatus including a charge-retentive member defining an imaging surface and a charging device for placing a charge on the imaging surface, comprising the steps of:

determining an age of the charge-retentive member; and providing a correction circuit of a predetermined design associated with the charging device, as a result of said determining step, the correction circuit comprising at least one diode in parallel with the charging device and at least one diode in series with the charging device.

24. A method of operating an electrostatographic printing apparatus, the apparatus including a charge-retentive member defining an imaging surface and a charging device for placing a charge on the imaging surface, comprising the steps of:

determining an age of the charge-retentive member; and providing a correction circuit of a predetermined design associated with the charging device, as a result of said determining step, the correction circuit comprising at least one capacitor in parallel with the charging device.

* * * * *